US010826234B2

(12) United States Patent
Penn et al.

(10) Patent No.: US 10,826,234 B2
(45) Date of Patent: Nov. 3, 2020

(54) CONNECTOR ASSEMBLY WITH DIRECT MOUNT HOUSING

(71) Applicant: Aptiv Technologies Limited, St. Michael (BB)

(72) Inventors: Matthew L. Penn, Cortland, OH (US); Jose Alberto Davila Aleman, Saltillo (MX)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 16/391,701

(22) Filed: Apr. 23, 2019

(65) Prior Publication Data

US 2019/0326706 A1 Oct. 24, 2019

Related U.S. Application Data

(60) Provisional application No. 62/661,277, filed on Apr. 23, 2018.

(51) Int. Cl.

| | |
|---|---|
| ***H01R 13/627*** | (2006.01) |
| ***H01R 24/40*** | (2011.01) |
| ***H01R 43/26*** | (2006.01) |
| ***H01R 13/50*** | (2006.01) |
| *H01R 103/00* | (2006.01) |
| *H01R 13/631* | (2006.01) |

(52) U.S. Cl.

CPC ..... *H01R 13/6273* (2013.01); *H01R 13/50* (2013.01); *H01R 24/40* (2013.01); *H01R 43/26* (2013.01); *H01R 13/631* (2013.01); *H01R 2103/00* (2013.01)

(58) Field of Classification Search

CPC .... H01R 13/6273; H01R 13/50; H01R 24/40; H01R 43/26

USPC ..... 439/357

See application file for complete search history.

(56) References Cited

U.S. PATENT DOCUMENTS 6,361,348 B1 * 3/2002 Hall ..... H01R 13/6277 439/352

6,491,542 B1 * 12/2002 Zerebilov ..... H01R 13/4226 439/352

(Continued)

FOREIGN PATENT DOCUMENTS

CN 203521819 U 4/2014

OTHER PUBLICATIONS

Design U.S. Appl. No. 29/650,542, filed Jun. 7, 2018, Matthew L. Penn.

*Primary Examiner* — Peter G Leigh

(74) *Attorney, Agent, or Firm* — Billion & Armitage; Robert Myers

(57) ABSTRACT

A connector assembly includes a housing. The housing defines a cavity configured to receive a coaxial electrical terminal. The housing has a first end an a second end opposite the first end. The housing also has a first side and a second side opposite the first side. The first side and second side have opposed locking ribs. The coaxial electrical terminal has a wire end and a terminal end oriented orthogonal to the wire end. When the housing engages a corresponding mounting bracket, locking arms extending from the corresponding mounting bracket impart a retention force on the opposed locking ribs and inhibit a rotation of the housing about a mating axis of the coaxial electrical terminal.

17 Claims, 7 Drawing Sheets

(56) References Cited

U.S. PATENT DOCUMENTS

| | | | | |
|---|---|---|---|---|
| 7,267,570 | B2 * | 9/2007 | Fry, Jr. | H01R 13/6272 439/357 |
| 7,285,011 | B2 * | 10/2007 | Hardy | H01R 13/506 439/582 |
| 7,347,742 | B2 * | 3/2008 | Hall | H01R 13/6272 439/542 |
| 7,794,274 | B2 * | 9/2010 | Phillips, Jr. | H01R 13/187 439/578 |
| 7,980,894 | B1 * | 7/2011 | Hall | H01R 9/053 439/585 |
| 8,277,248 | B2 * | 10/2012 | Blakborn | H01R 13/41 439/581 |
| 8,366,483 | B2 * | 2/2013 | Hardy | H01R 9/0518 439/578 |
| 9,537,231 | B2 * | 1/2017 | Hall | H01R 13/434 |
| 9,680,256 | B1 * | 6/2017 | Lane | H01R 13/6275 |
| 2007/0020986 | A1 * | 1/2007 | Fry, Jr. | H01R 13/6272 439/357 |
| 2007/0093120 | A1 | 4/2007 | Hardy et al. | |
| 2009/0017678 | A1 * | 1/2009 | Meier | H01R 9/0518 439/582 |
| 2011/0217870 | A1 * | 9/2011 | Blakborn | H01R 13/41 439/578 |
| 2017/0271815 | A1 * | 9/2017 | Lane | H01R 13/62927 |
| 2018/0026408 | A1 * | 1/2018 | Ensley | H01R 24/38 439/578 |
| 2018/0097309 | A1 | 4/2018 | Haspel et al. | |

* cited by examiner

CONNECTOR ASSEMBLY WITH DIRECT MOUNT HOUSING

CROSS-REFERENCE TO RELATED APPLICATION

This application claims the benefit under 35 U.S.C. § 119(e) of U.S. Provisional Patent Application No. 62/661,277, filed Apr. 23, 2018, the entire disclosure of which is hereby incorporated herein by reference.

TECHNICAL FIELD OF INVENTION

This disclosure generally relates to an electrical connector assembly with direct mount features.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well known methods, procedures, components, circuits, and networks have not been described in detail so as not to unnecessarily obscure aspects of the embodiments.

Figure 1:
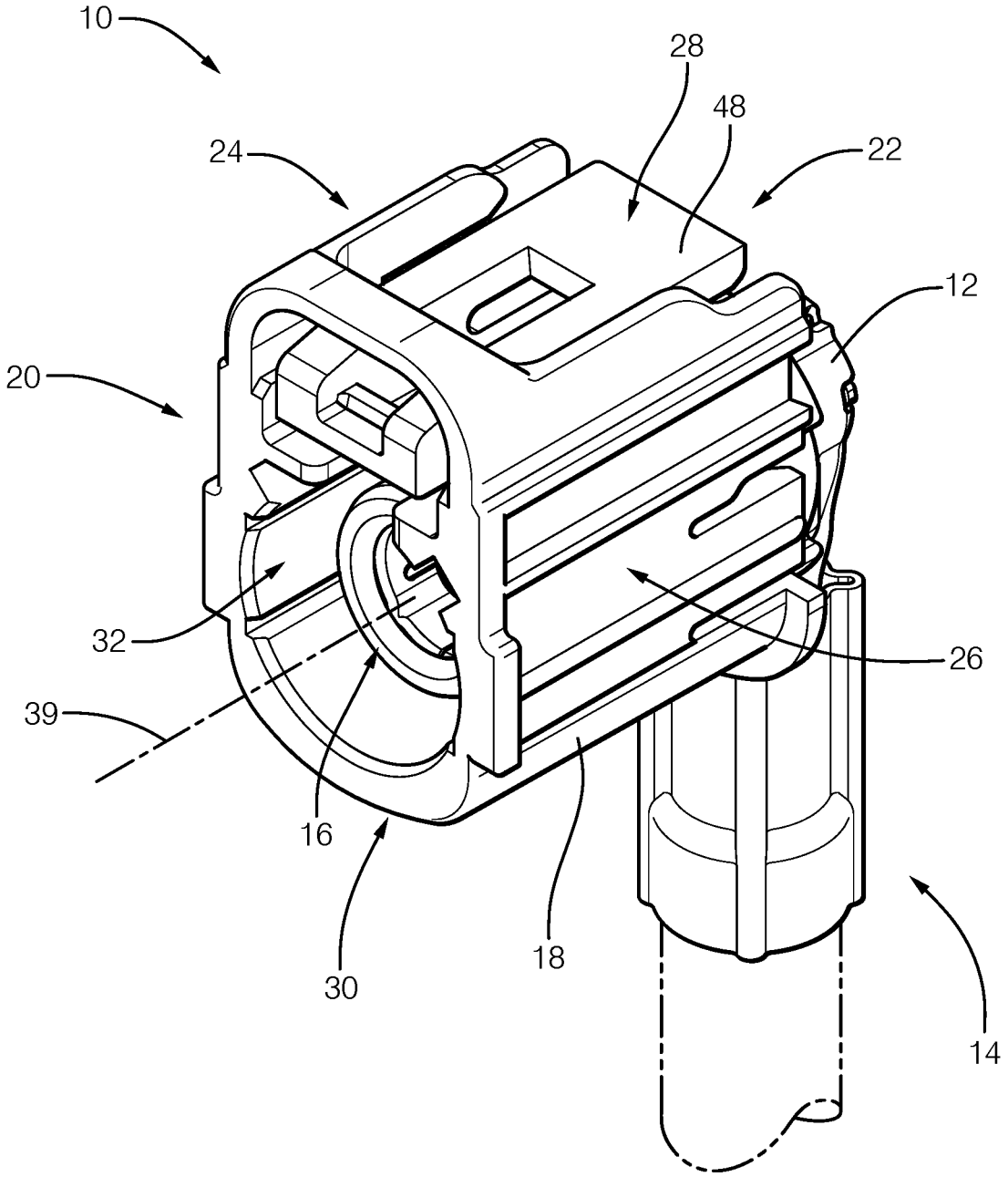
FIG. 1 is a perspective view of a connector assembly in accordance with one embodiment.

FIG. 1 illustrates a connector assembly 10, hereafter referred to as the assembly 10. The assembly 10 is configured to be directly mounted to a bracket and provide structural support for a mating connector (not shown). The assembly 10 includes a coaxial electrical terminal 12 configured to receive a corresponding coaxial electrical terminal (not shown). The coaxial electrical terminal 12 has a wire end 14 and a terminal end 16 oriented orthogonal to the wire end 14. That is, the wire end 14 and the terminal end 16 are oriented 90 degrees from one another (i.e., a right-angle terminal). The coaxial electrical terminal 12 is configured to be attached to a wire cable (not shown) at the wire end 14, that may be a component of a wiring harness of a vehicle.

In the example illustrated in FIG. 1, the coaxial electrical terminal 12 is compatible with a Fachkreis Automobil (FAKRA) standard, hereafter referred to as FAKRA. FAKRA is an electrical standard that defines coaxial connectors used in automotive communication systems that include global positioning systems (GPS), satellite radio, cellular phone, and some FM radio signals. FAKRA defines several different configurations of female and male connector housings, and configurations of electrical terminals retained by the connector housings.

The assembly 10 also includes a housing 18 formed of a polymeric dielectric material. The polymeric dielectric material may be any polymeric dielectric material capable of electrically isolating portions of the coaxial electrical terminal 12. In an example, the polymeric dielectric material is a polyamide (NYLON) material. In another example, the polyamide includes a glass fiber fill. In another example the polymeric dielectric material is polypropylene. The housing 18 is configured to mate with a corresponding housing that retains the corresponding coaxial electrical terminal of the mating FAKRA connector.

The housing 18 has a first end 20 and a second end 22 opposite the first end 20, a first side 24 and a second side 26 opposite the first side 24, and a top side 28 and a bottom side 30 opposite the top side 28. The top side 28 includes a connector lock 48 configured to releasably lock the mating connector to the assembly 10 in a mated position. In an example, a wall thickness of the first side 24 and the second side 26 of the housing 18 is less than 1.0 mm, and the wall thickness of the bottom side is less than 1.5 mm. The relatively thin wall thicknesses enable a smaller packaging envelope compared to other assemblies, and a reduced material cost.

Figure 2:
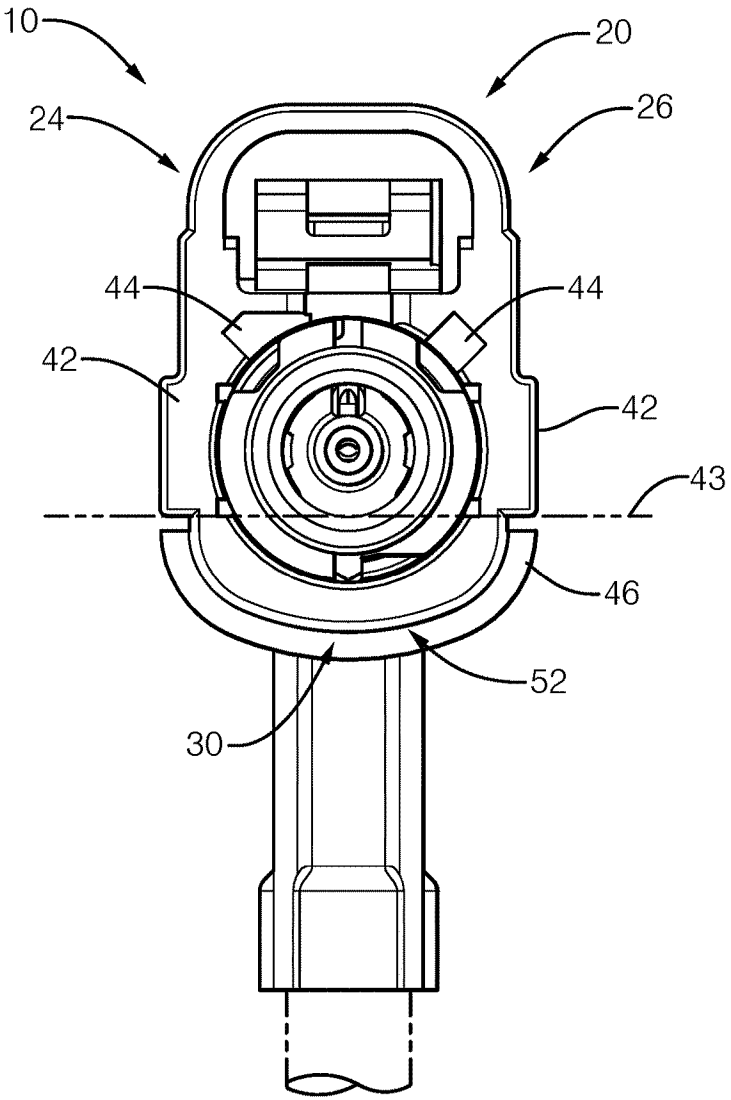
FIG. 2 is a front view of the connector assembly of FIG. 1 in accordance with one embodiment.
Figure 9:
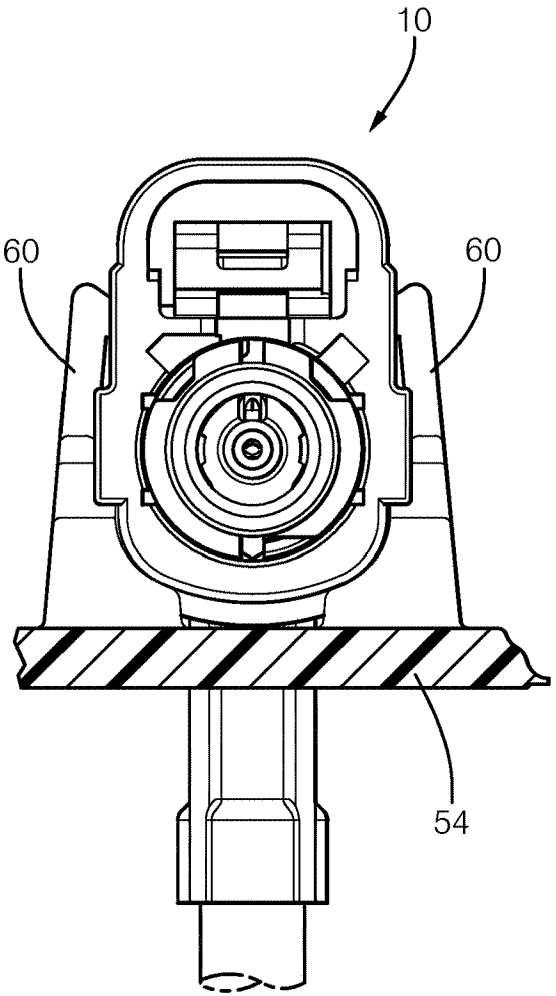
FIG. 9 is an front view of the connector assembly of FIG. 1 retained in the corresponding mounting bracket in accordance with one embodiment.

FIG. 2 is a front view of the assembly 10 of FIG. 1, and illustrates the first end 20 of the housing 18. The first end 20 of the housing 18 includes a first flange 42 extending beyond a portion of both the first side 24 and the second side 26. The first end 20 defines indexing features 44 recessed into the first end 20 proximate the top side 28 of the housing 18. The indexing features 44 are compatible with FAKRA and are configured to receive corresponding indexing features 44 from the mating FAKRA connector. The first flange 42 is configured to engage a shoulder on a corresponding mounting bracket 54 (see FIG. 9) and inhibit movement along the mating axis 39, and inhibit rotation of the assembly 10 about the mating axis 39. The first flange 42 is positioned above a longitudinal plane 43 defined by the housing 18 and is orthogonal the longitudinal plane 43. In an example, a thickness of the first flange 42 is less than 1.5 mm.

Figure 3:
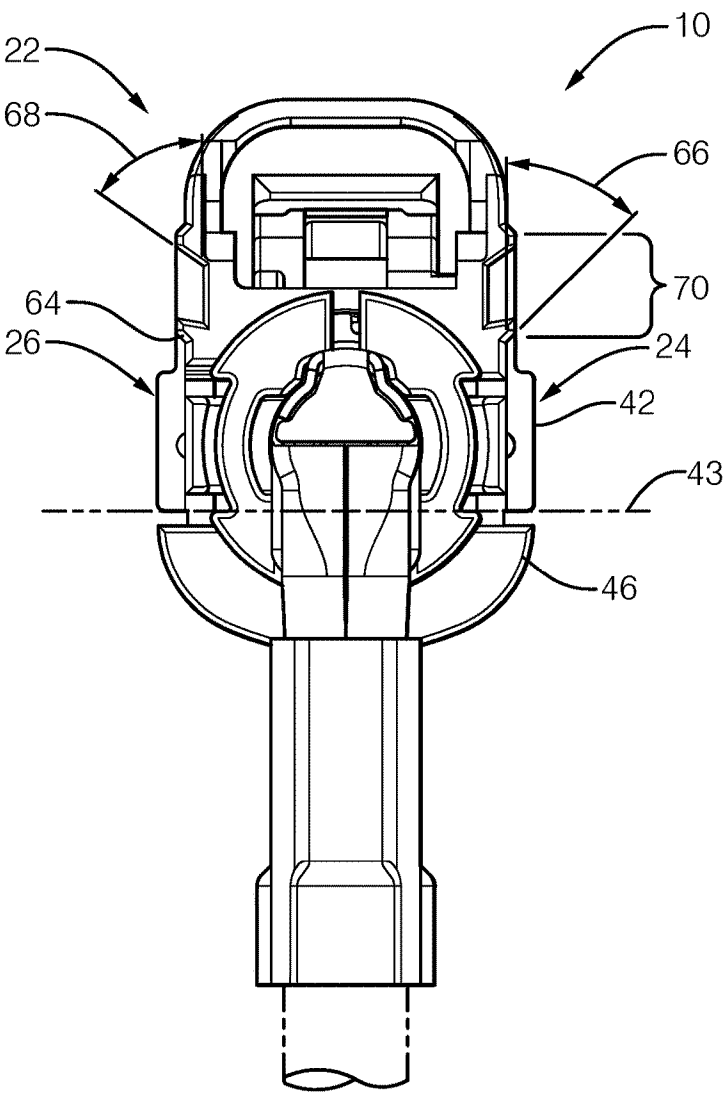
FIG. 3 is a rear view of the connector assembly of FIG. 1 in accordance with one embodiment.
Figure 8:
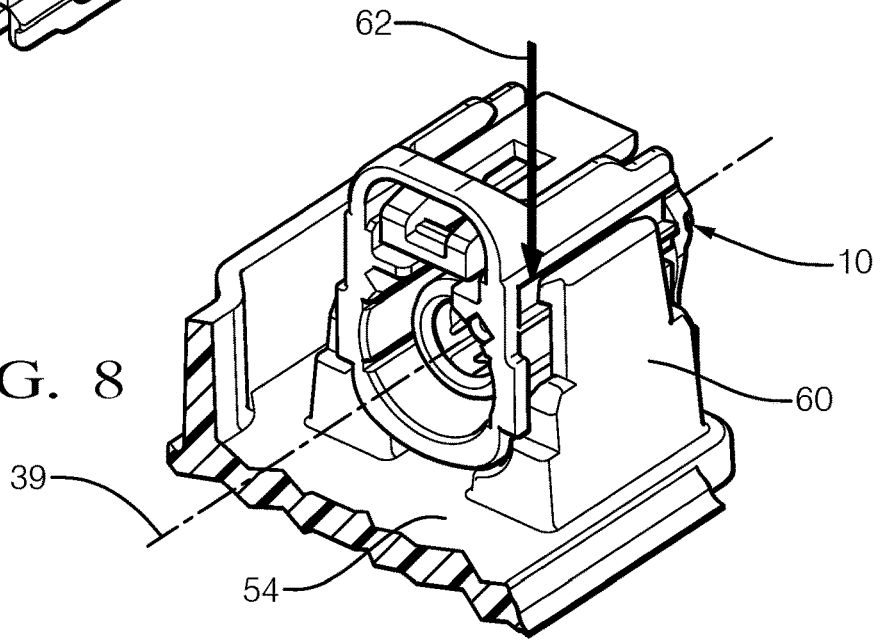
FIG. 8 is a top perspective view of the connector assembly of FIG. 1 retained in a corresponding mounting bracket in accordance with one embodiment.
Figure 11:
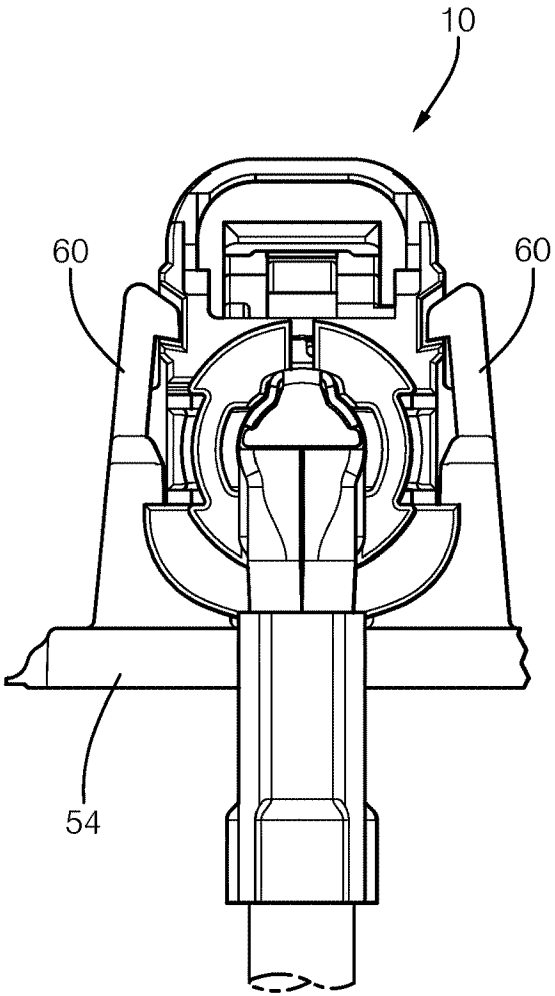
FIG. 11 is a rear view of the connector assembly of FIG. 1 retained in the corresponding mounting bracket in accordance with one embodiment.
Figure 10:
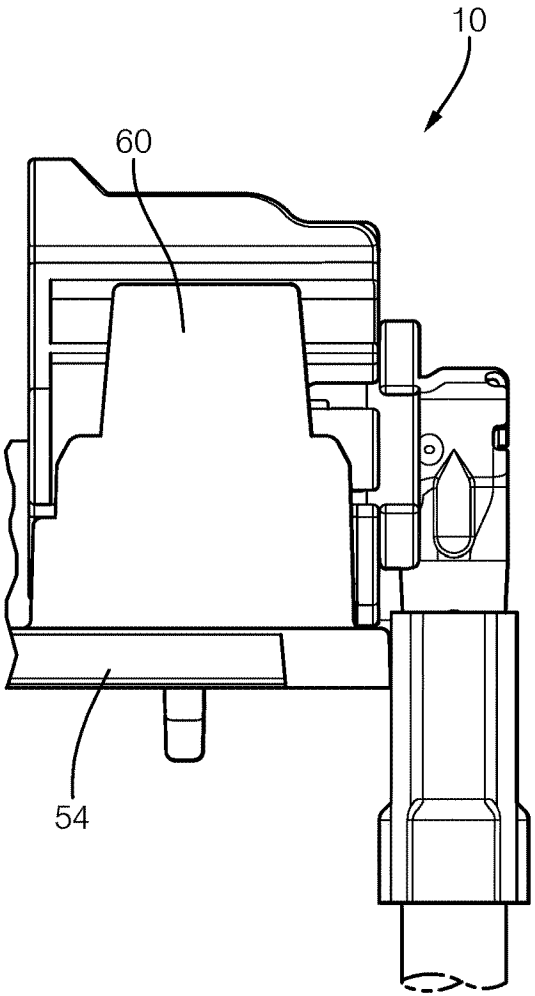
FIG. 10 is a right side view of the connector assembly of FIG. 1 retained in the corresponding mounting bracket in accordance with one embodiment.

FIG. 3 is a rear view of the assembly 10 and illustrates the second end 22 of the housing 18. The second end 22 includes a second flange 46 extending beyond the bottom side 30 and extending beyond portions of both the first side 24 and the second side 26. The second flange 46 is positioned below the longitudinal plane 43 defined by the housing 18 and is orthogonal the longitudinal plane 43. The second flange 46 is configured to engage a face of the corresponding mounting bracket 54 (see FIG. 8) and inhibit movement along the mating axis 39. In an example the thickness of the second flange 46 is less than 1.5 mm.

Figure 5:
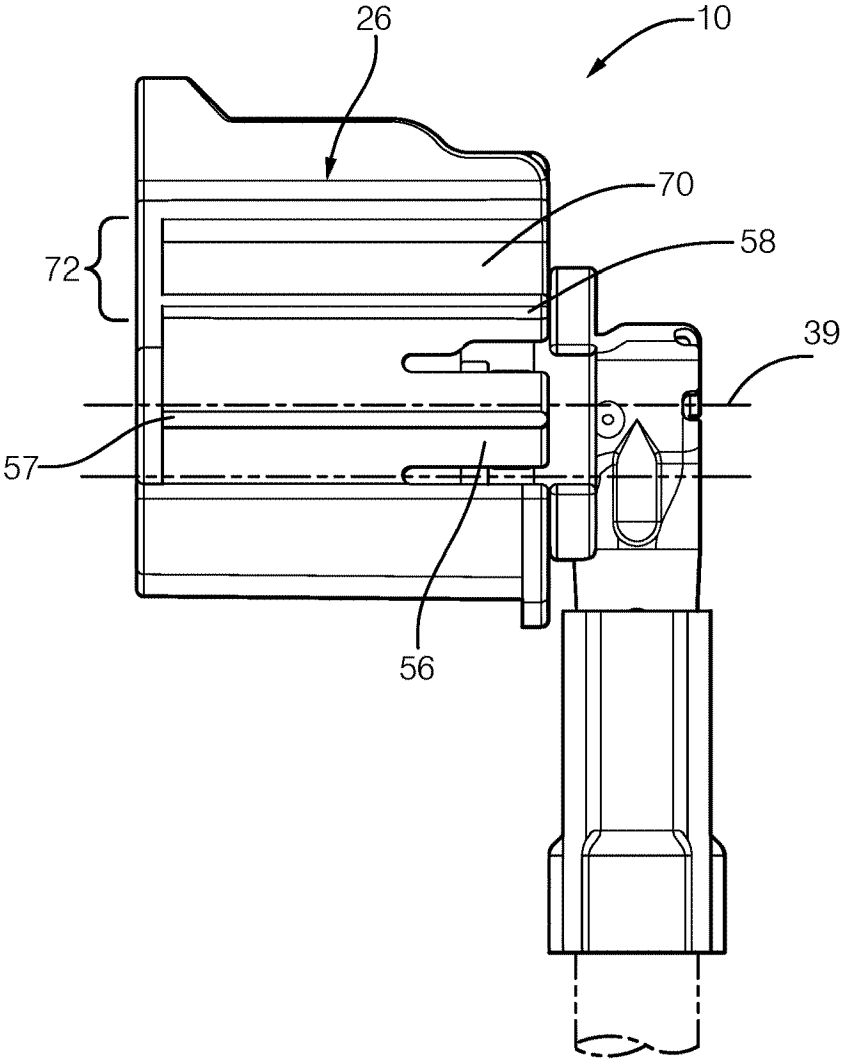
FIG. 5 is a second side view of the connector assembly of FIG. 1 in accordance with one embodiment.
Figure 4:
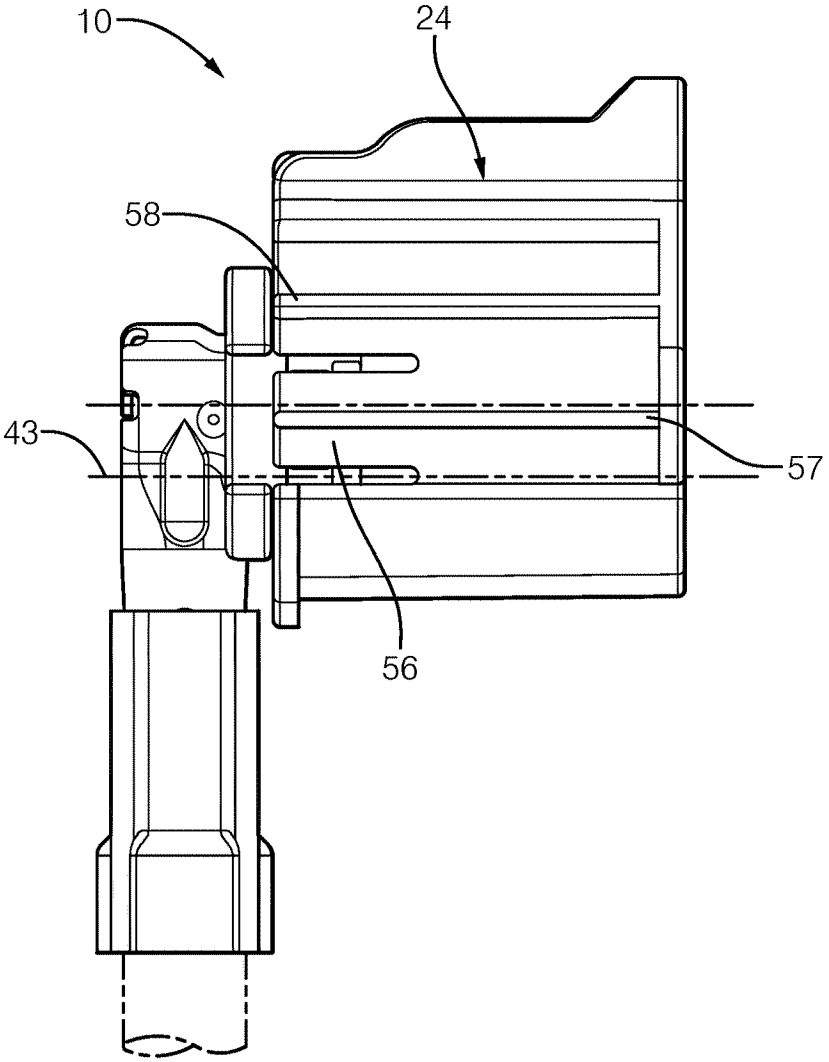
FIG. 4 is a first side view of the connector assembly of FIG. 1 in accordance with one embodiment.
Figure 15:
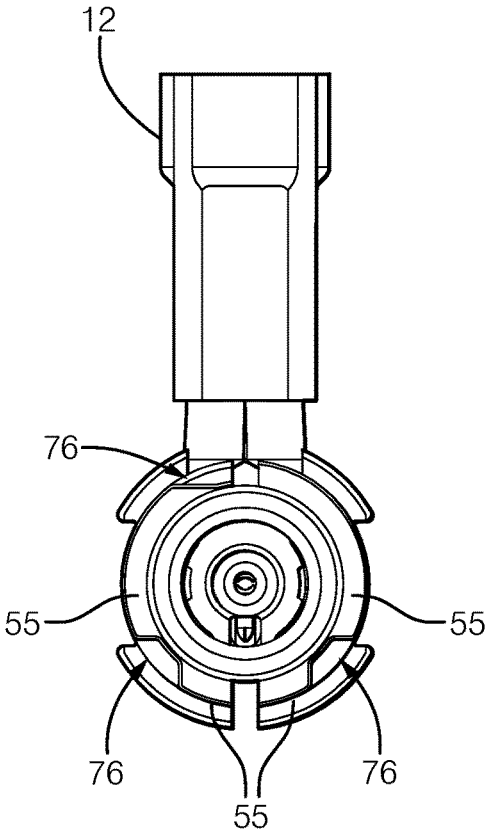
FIG. 15 is a front view of a coaxial electrical terminal of FIG. 1 in accordance with one embodiment.
Figure 16:
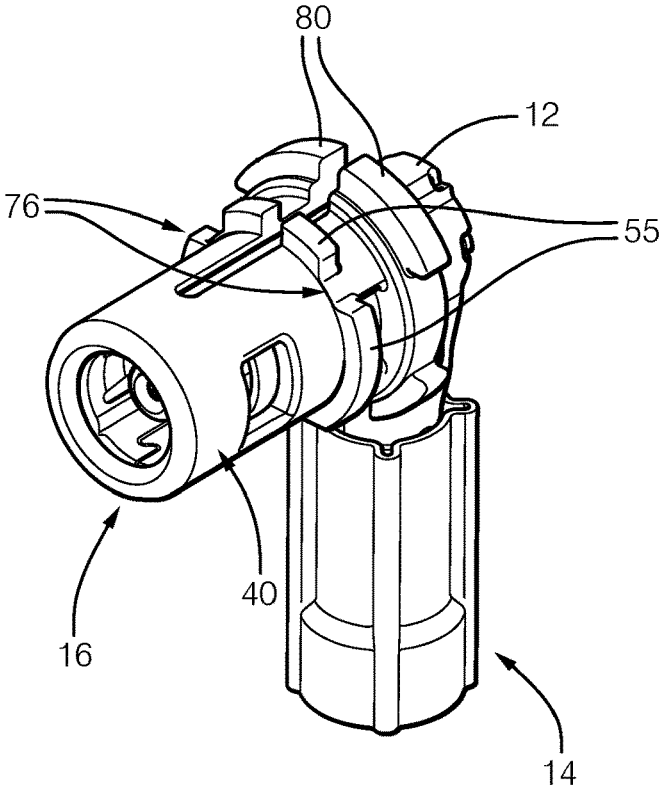
FIG. 16 is a rear view of the coaxial electrical terminal of FIG. 15 in accordance with one embodiment.

FIGS. 4-5 illustrate the first side 24 and the second side 26 of the assembly 10. The first side 24 and the second side 26 include opposed flexible locks 56 extending from middle sections of the first side 24 and the second side 26. The opposed flexible locks 56 are aligned parallel to the mating axis 39 of the assembly 10 and terminate at the second end 22 of the housing 18. The opposed flexible locks 56 are configured to removably retain the coaxial electrical terminal 12 within a cavity 32 defined by the housing 18, and inhibit movement of the coaxial electrical terminal 12 along the mating axis 39. The opposed flexible locks 56 include chamfers on leading edges of the opposed flexible locks 56. The chamfers engage lugs 55 on an outer surface 40 of the coaxial electrical terminal 12 (see FIGS. 15-16) that deflect the opposed flexible locks 56 outwardly as the coaxial electrical terminal 12 is inserted along the mating axis 39 into the housing 18. The opposed flexible locks 56 return to a relaxed state as the lugs 55 pass beyond the chamfers. In this relaxed state, the opposed flexible locks 56 lock against a back side of the lugs 55. The chamfers also enable a tool, such as a screwdriver, to be inserted between the opposed flexible locks 56 and the outer surface 40 of the coaxial electrical terminal 12, enabling a removal of the coaxial electrical terminal 12 from the housing 18.

In the examples illustrated in FIGS. 4-5, the first side 24 and the second side 26 include stiffening ribs 57 extending from the first end 20 to the second end 22. The stiffening ribs 57 are aligned parallel to the mating axis 39 and overlay the opposed flexible locks 56. The stiffening ribs 57 increase a stiffness of the opposed flexible locks 56 and increase a removal force required to remove the coaxial electrical terminal 12 from the housing 18. In an example, the height of the stiffening ribs 57 is between 0.5 mm and 1.0 mm.

The first side 24 and the second side 26 also include opposed locking ribs 58 extending beyond the first side 24 and the second side 26. The opposed locking ribs 58 are parallel to the mating axis 39 and extend from the first flange 42 and terminate at the second end 22. The opposed locking ribs 58 are positioned proximate the top side 28 and are configured to receive the locking arms 60 extending from the corresponding mounting bracket 54 (see FIGS. 8-12). The proximity of the opposed locking ribs 58 to the top side 28 further inhibits the rotation of the assembly 10 within the corresponding mounting bracket 54. In the examples illustrated in FIGS. 4-5, the opposed locking ribs 58 extend beyond the first side 24 and the second side 26 in a range of about 1.0 mm to about 2.0 mm. The opposed locking ribs 58 define a locking slot 70 that extends from the opposed locking ribs 58 to the top side 28 of the housing 18. The locking slot 70 is configured to receive ends of the locking arms 60 when the locking arms 60 engage the opposed locking ribs 58. In an example, the locking slot 70 has a height 72 of at least 5.0 mm. Referring back to FIG. 3, a lower surface 64 of the opposed locking ribs 58 define an angle 66 of less than 45 degrees relative to the first side 24 and the second side 26. An upper surface of the opposed locking ribs 58 defines an engagement angle 68 less than 90 degrees relative to the first side 24 and the second side 26. The engagement angle 68 is configured to retain the ends of the locking arms 60 extending from the corresponding mounting bracket 54.

Figure 6:
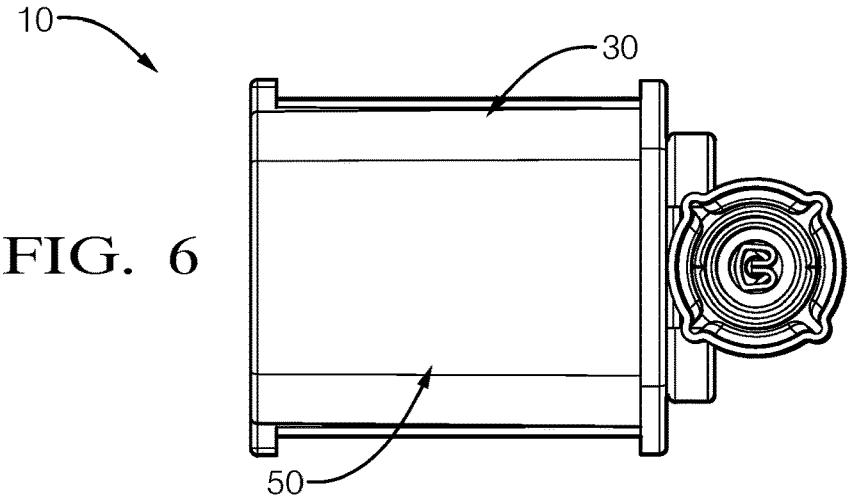
FIG. 6 is a bottom view of the connector assembly of FIG. 1 in accordance with one embodiment.
Figure 7:
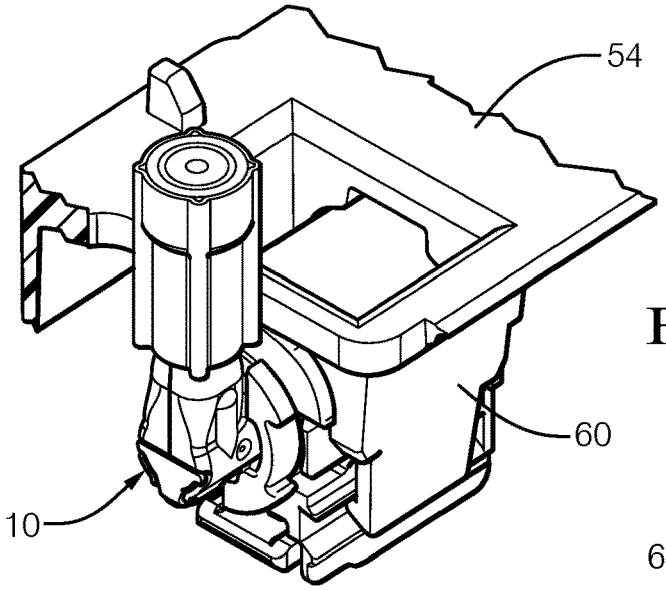
FIG. 7 is a bottom perspective view of the connector assembly of FIG. 1 retained in a corresponding mounting bracket in accordance with one embodiment.

FIG. 6 illustrates the bottom side 30 of the assembly 10. The bottom side 30 has a continuous surface 50 having a generally elliptically shaped profile 52 (see FIG. 2) configured to engage a bottom surface of the corresponding mounting bracket 54 (see FIGS. 7-11). The bottom surface of the corresponding mounting bracket 54 is configured to support the elliptically shaped profile 52 of the bottom side 30 of the housing 18, and further inhibits the rotation of the assembly 10 about the mating axis 39.

FIGS. 7-11 illustrate the assembly 10 retained in the corresponding mounting bracket 54. When the bottom side 30 of the assembly 10 engages the corresponding mounting bracket 54, the locking arms 60 impart a retention force 62 (see FIG. 8) on the opposed locking ribs 58 and inhibit the rotation of the housing 18 about the mating axis 39. As described above, the lower surface 64 of the opposed locking ribs 58 define the angle 66 of less than 45 degrees. The lower surface 64 of the opposed locking ribs 58 engages the ends of the locking arms 60 and deflects the locking arms 60 outwardly, enabling an engagement force sufficient to meet ergonomic requirements of the assembly process. The engagement angle 68 of the opposed locking ribs 58 (see FIG. 3) is configured to engage the ends of the locking arms 60 when the assembly 10 is seated in the corresponding mounting bracket 54 and inhibit the removal and rotation of the assembly 10.

Figure 14:
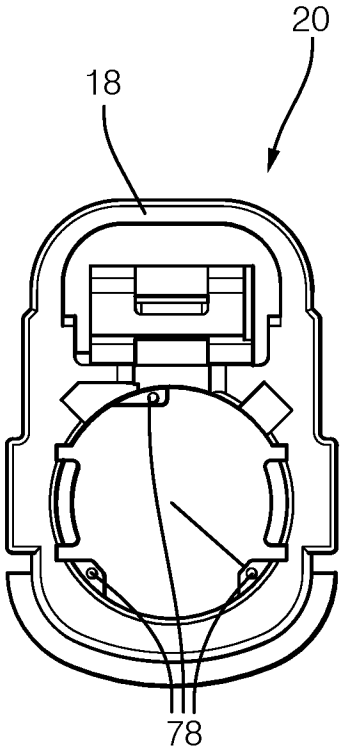
FIG. 14 is a rear view of the connector housing of FIG. 12 in accordance with another embodiment.
Figure 13:
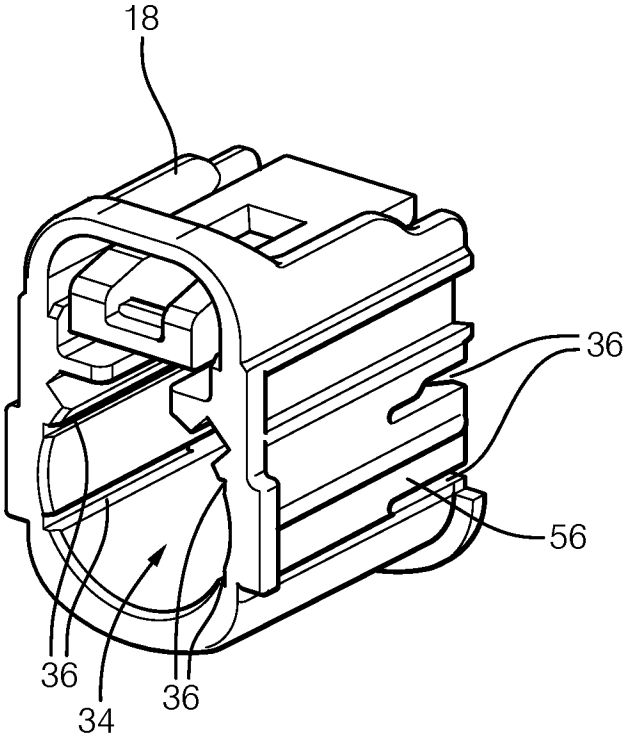
FIG. 13 is a front perspective view of the connector housing of FIG. 12 in accordance with another embodiment.
Figure 12:
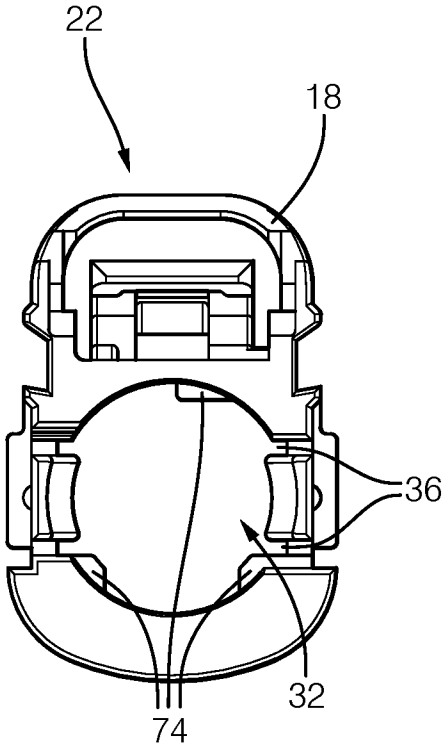
FIG. 12 is an front view of a connector housing of FIG. 1 in accordance with another embodiment.

FIGS. 12-14 illustrate the housing 18 isolated from the assembly 10. The cavity 32 defined by housing 18 is configured to receive the coaxial electrical terminal 12 through the second end 22 of the housing 18. The cavity 32 defines an inner surface 34 (see FIG. 13) that is generally cylindrically shaped to support the outer surface 40 of the coaxial electrical terminal 12. The inner surface 34 defines relief slots 36 configured to reduce strain limits on the flexible locks 56. The relief slots 36 extend from the first end 20 to the second end 22 and are aligned parallel to the mating axis 39. The relief slots 36 are positioned in the housing 18 so as to define an upper bounds and a lower bounds to each of the flexible locks 56.

FIG. 12 illustrates the housing 18 viewed from the second end 22. The housing 18 includes at least three tabs 74 extending beyond the inner surface 34 into the cavity 32 and are aligned orthogonal to the mating axis 39. The tabs 74 are configured to retain the coaxial electrical terminal 12 in the housing 18. As the coaxial electrical terminal 12 is inserted into the housing 18, cut-outs 76 in the lugs 55 (see FIGS. 14-15) of the coaxial electrical terminal 12 enable the coaxial electrical terminal 12 to move past the tabs 74 and be fully seated in the housing 18. Stops 80 (see FIG. 16) extending from the outer surface 40 of the coaxial electrical terminal 12 engage the second end 22 of the housing 18, when the coaxial electrical terminal 12 is fully seated in the housing 18, and control a depth of insertion of the coaxial electrical terminal 12. The coaxial electrical terminal 12 may then be rotated about the mating axis 39 so that at least two of the at least three tabs 74 engage the lugs 55 at positions away from the cut-outs 76, further inhibiting the removal of the coaxial electrical terminal 12 from the housing 18.

FIG. 14 illustrates the housing 18 viewed from the first end 20. Each of the at least three tabs 74 include a protrusion 78 extending from a surface of the tabs 74 toward the first end 20. The protrusions 78 are configured to engage the lugs 55 of the coaxial electrical terminal 12 when the coaxial electrical terminal 12 is fully seated in the housing 18 and is rotated about the mating axis 39. The protrusions 78 increase a frictional force between the tabs 74 and the lugs 55 that inhibits the rotation of the coaxial electrical terminal 12 within the housing 18.

Accordingly, a connector assembly 10 is provided. The connector assembly 10 is an improvement over other connector assemblies because the connector assembly 10 has the direct mount feature that inhibits the housing 18 from rotating within the corresponding mounting bracket 54.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

Clauses

1. A connector assembly, comprising:
   a housing defining a cavity configured to receive a coaxial electrical terminal;
   the housing having a first end an a second end opposite the first end, and a first side and a second side opposite the first side;
   the first side and second side having opposed locking ribs;
   the coaxial electrical terminal having a wire end and a terminal end oriented orthogonal to the wire end; wherein
   when the housing engages a corresponding mounting bracket, locking arms extending from the corresponding mounting bracket impart a retention force on the opposed locking ribs and inhibit a rotation of the housing about a mating axis of the coaxial electrical terminal.

2. The connector assembly in accordance with clause 1, wherein the cavity receives the coaxial electrical terminal through the second end.

3. The connector assembly in accordance with any one of the preceding clauses, wherein the cavity defines an inner surface, and the inner surface defines relief slots configured to reduce strain on opposed flexible locks of the housing.

4. The connector assembly in accordance with clause 3, wherein the housing includes at least three tabs extending beyond the inner surface orthogonal to the mating axis.

5. The connector assembly in accordance with clause 4, wherein at least two of the at least three tabs are configured to engage lugs extending from an outer surface of the coaxial electrical terminal.

6. The connector assembly in accordance with clause 5, wherein each of the at least three tabs include a protrusion extending from a surface of the at least three tabs toward the first end;
   the protrusion configured to engage the lugs of the coaxial electrical terminal when the coaxial electrical terminal is rotated about the mating axis.

7. The connector assembly in accordance with clause 3, wherein the relief slots on the inner surface extend from the first end to the second end.

8. The connector assembly in accordance with any one of the preceding clauses, wherein the first end defines indexing features recessed into the first end proximate a top side of the housing, the indexing features configured to receive corresponding indexing features from a mating connector.

9. The connector assembly in accordance with clause 8, wherein the indexing features on the first end are compatible with a Fachkreis Automobil (FAKRA) standard.

10. The connector assembly in accordance with any one of the preceding clauses, wherein the first end includes a first flange extending beyond a portion of both the first side and the second side.

11. The connector assembly in accordance with any one of the preceding clauses, wherein the second end includes a second flange extending beyond a bottom side of the housing, and extending beyond a portion of the first side and a portion of the second side proximate the bottom side.

12. The connector assembly in accordance with any one of the preceding clauses, wherein a top side of the housing includes a connector lock configured to releasably lock a mating connector in a mated position.

13. The connector assembly in accordance with any one of the preceding clauses, wherein a bottom side of the housing has a continuous surface having a generally elliptically shaped profile configured to engage the corresponding mounting bracket.

14. The connector assembly in accordance with any one of the preceding clauses, wherein the first side and the second side include opposed flexible locks extending from a middle section of the first side and the second side parallel to the mating axis and terminate at the second end;
   the opposed flexible locks configured to retain the coaxial electrical terminal within the cavity.

15. The connector assembly in accordance with clause 14, wherein the first side and the second side include stiffening ribs extending from the first end to the second end;

the stiffening ribs aligned parallel to the mating axis and overlaying the opposed flexible locks.

16. The connector assembly in accordance with any one of the preceding clauses, wherein the opposed locking ribs extend beyond the first side and the second side from a first flange and terminate at the second end;

the opposed locking ribs aligned parallel to the mating axis.

17. The connector assembly in accordance with any one of the preceding clauses, wherein the opposed locking ribs are positioned proximate a top side of the housing and are configured to receive the locking arms extending from the corresponding mounting bracket.

18. The connector assembly in accordance with any one of the preceding clauses, wherein a first flange is positioned above a longitudinal plane defined by the housing;

the first flange aligned orthogonal to the longitudinal plane.

19. The connector assembly in accordance with any one of the preceding clauses, wherein a second flange is positioned below a longitudinal plane defined by the housing;

the second flange aligned orthogonal to the longitudinal plane.

20. A method comprising:

installing a housing of a connector assembly in a corresponding mounting bracket;

the housing defining a cavity configured to receive a coaxial electrical terminal;

the housing having a first end an a second end opposite the first end, and a first side and a second side opposite the first side;

the first side and second side having opposed locking ribs;

the coaxial electrical terminal having a wire end and a terminal end oriented orthogonal to the wire end; wherein when the housing engages the corresponding mounting bracket, locking arms extending from the corresponding mounting bracket impart a retention force on the opposed locking ribs of the housing and inhibit a rotation of the housing about a mating axis of the coaxial electrical terminal.

We claim:

1. A connector assembly, comprising:

a housing defining a cavity configured to receive a coaxial electrical terminal, wherein the housing has a first end and a second end opposite the first end, wherein the housing has a first side and a second side opposite the first side having opposed locking ribs, wherein the coaxial electrical terminal has a wire end and a terminal end oriented orthogonally relative to the wire end, wherein locking arms extending from the corresponding mounting bracket impart a retention force on the opposed locking ribs and inhibit a rotation of the housing about a mating axis of the coaxial electrical terminal when the housing engages a corresponding mounting bracket, wherein the cavity defines an inner surface which defines relief slots configured to reduce strain on opposed flexible locks of the housing, and wherein the housing includes three tabs extending beyond the inner surface in a direction orthogonal to the mating axis.

2. The connector assembly in accordance with claim 1, wherein the cavity receives the coaxial electrical terminal through the second end.

3. The connector assembly in accordance with claim 1, wherein at least two of the three tabs are configured to engage lugs extending from an outer surface of the coaxial electrical terminal.

4. The connector assembly in accordance with claim 3, wherein each of the three tabs include a protrusion extending from a surface of the three tabs toward the first end, wherein the protrusion is configured to engage the lugs of the coaxial electrical terminal when the coaxial electrical terminal is rotated about the mating axis.

5. The connector assembly in accordance with claim 1, wherein the relief slots on the inner surface extend from the first end to the second end.

6. The connector assembly in accordance with claim 1, wherein the first end defines indexing features recessed into the first end proximate a top side of the housing, the indexing features configured to receive corresponding indexing features from a mating connector.

7. The connector assembly in accordance with claim 6, wherein the indexing features on the first end are compatible with a Fachkreis Automobil (FAKRA) standard.

8. The connector assembly in accordance with claim 1, wherein the first end includes a first flange extending beyond a portion of both the first side and the second side.

9. The connector assembly in accordance with claim 1, wherein the second end includes a second flange extending beyond a bottom side of the housing, and extending beyond a portion of the first side and a portion of the second side proximate the bottom side.

10. The connector assembly in accordance with claim 1, wherein a top side of the housing includes a connector lock configured to releasably lock a mating connector in a mated position.

11. The connector assembly in accordance with claim 1, wherein a bottom side of the housing has a continuous surface having a generally elliptically shaped profile configured to engage the corresponding mounting bracket.

12. The connector assembly in accordance with claim 1, wherein the opposed locking ribs extend beyond the first side and the second side from a first flange and terminate at the second end wherein the opposed locking ribs are in parallel alignment with the mating axis.

13. The connector assembly in accordance with claim 1, wherein the opposed locking ribs are positioned proximate a top side of the housing and are configured to receive the locking arms extending from the corresponding mounting bracket.

14. The connector assembly in accordance with claim 1, wherein a first flange is positioned above a longitudinal plane defined by the housing, wherein the first flange is in orthogonal alignment with the longitudinal plane.

15. The connector assembly in accordance with claim 1, wherein a second flange is positioned below a longitudinal plane defined by the housing, wherein the second flange is in orthogonal alignment with the longitudinal plane.

16. A connector assembly, comprising:

a housing defining a cavity configured to receive a coaxial electrical terminal, wherein the housing has a first end and a second end opposite the first end, wherein the housing has a first side and a second side opposite the first side having opposed locking ribs, wherein the coaxial electrical terminal has a wire end and a terminal end oriented orthogonally relative to the wire end, and wherein locking arms extending from the corresponding mounting bracket impart a retention force on the opposed locking ribs and inhibit a rotation of the housing about a mating axis of the coaxial electrical terminal when the housing engages a corresponding mounting bracket, wherein the first side and the second side include opposed flexible locks extending from a middle section of the first side and the second side parallel to the mating axis and terminate at the second end, wherein the opposed flexible locks are configured to retain the coaxial electrical terminal within the cavity, and wherein the first side and the second side include stiffening ribs extending from the first end to the second end wherein the stiffening ribs are aligned parallel to the mating axis and overlay the opposed flexible locks.

17. A method comprising:

installing a housing of a connector assembly in a corresponding mounting bracket, wherein the housing defines a cavity configured to receive a coaxial electrical terminal, wherein the housing has a first end an a second end opposite the first end, wherein the housing has a first side and a second side opposite the first side; having opposed locking ribs, wherein the coaxial electrical terminal has a wire end and a terminal end oriented orthogonally relative to the wire end; wherein locking arms extending from the corresponding mounting bracket impart a retention force on the opposed locking ribs of the housing and inhibit a rotation of the housing about a mating axis of the coaxial electrical terminal when the housing engages the corresponding mounting bracket, wherein the cavity defines an inner surface which defines relief slots configured to reduce strain on opposed flexible locks of the housing, and wherein the housing includes three tabs extending beyond the inner surface in a direction orthogonal to the mating axis.

* * * * *